United States Patent [19]

Steigerwald et al.

[11] 4,282,610

[45] Aug. 11, 1981

[54] PROTECTIVE HEADGEAR

[75] Inventors: Carl J. Steigerwald, Wauconda; Frank K. Villari, Oak Park, both of Ill.

[73] Assignee: The Kendall Company, Boston, Mass.

[21] Appl. No.: 966,534

[22] Filed: Dec. 4, 1978

Related U.S. Application Data

[63] Continuation of Ser. No. 869,568, Jan. 16, 1978, abandoned.

[51] Int. Cl.[3] ..... A42B 3/00

[52] U.S. Cl. ..... 2/414

[58] Field of Search ..... 2/16, 22, 23, 24, 411, 2/412, 413, 414, 6, 410, 415, 424, 425; 428/315, 310, 313, 311, 304, 345.1; 52/173 DS, 506, 716, 717, 507

[56] References Cited

U.S. PATENT DOCUMENTS

| | | | |
|---|---|---|---|
| 2,603,909 | 7/1952 | Pettibone | 248/345.1 |
| 2,845,997 | 8/1958 | Waite . | |
| 2,863,151 | 12/1958 | Morgan, Jr. | 2/414 |
| 2,908,943 | 10/1959 | Miller . | |
| 3,153,792 | 10/1964 | Marietta | 2/414 |
| 3,248,738 | 5/1966 | Morgan | 2/414 X |
| 3,259,910 | 7/1966 | Daignault | 2/24 |
| 3,446,880 | 5/1969 | Enicks . | |
| 3,497,873 | 3/1970 | Benner | 2/414 |
| 3,562,985 | 2/1971 | Nicosia | 428/313 X |
| 3,591,863 | 7/1971 | Rickard | 2/415 |
| 3,873,407 | 3/1975 | Kunata et al. | 428/315 X |
| 3,922,429 | 11/1975 | Welch et al. | 428/315 |
| 3,929,948 | 12/1975 | Welch et al. | |
| 3,994,022 | 11/1976 | Villari et al. | 2/413 |

FOREIGN PATENT DOCUMENTS

| | | | |
|---|---|---|---|
| 534612 | 12/1956 | Canada | 428/313 |
| 1137199 | 9/1962 | Fed. Rep. of Germany | 428/313 |
| 1508520 | 1/1968 | France | 428/313 |

*Primary Examiner*—Werner H. Schroeder
*Assistant Examiner*—Andrew M. Falik
*Attorney, Agent, or Firm*—Powell L. Sprunger

[57] ABSTRACT

A protective headgear comprising a helmet and a pad assembly. The pad assembly comprises a pad of foam material having an integral densified layer defining front and side surfaces of the pad assembly and forming a tear-resistant cover for the pad. The pad assembly has a relatively rigid attachment plate bonded to the pad adjacent a back surface of the pad assembly for securing the pad assembly to the helmet.

9 Claims, 10 Drawing Figures

PROTECTIVE HEADGEAR

This is a continuation of application Ser. No. 869,568 filed Jan. 16, 1978 now abandoned.

BACKGROUND OF THE INVENTION

The present invention relates to protective headgear, and more particularly to pads for such headgear.

Before the present invention, protective pads have been proposed for use in headgear, such as football helmets, to prevent harm to the wearer's jaws during use of the helmets. In one form, such protective pads have been constructed from an inner pad which is located between two sheets of leather, with the sheets being sewn together along their sides. In an alternative form, the inner pad has been retained between two plastic sheets which are sealed together at their edges. However, in both cases the sheets do not readily conform to the shape of the inner pad resulting in a relatively unsightly protective pad which assumes a sausage-like configuration. The sheets either cover the inner pad too loosely or too tightly, and, in the latter case, undue stress is placed against the sheets by the inner pad, particularly during use of the helmet, resulting in seam splitting of the sheets. Moreover, such sheets are not sufficiently soft and conformable to provide the desired comfort for the wearer's skin, and the pads are relatively complicated in structure, thus adding to the cost of the pad and the headgear to the consumer.

SUMMARY OF THE INVENTION

The present invention relates to an improved pad assembly for a protective helmet.

The pad assembly of the present invention has a back surface, a front surface, and side surfaces connecting the back and front surfaces. The pad assembly has a pad of foam material having an integral densified layer defining the front surface and at least a substantial part of the side surfaces of the pad assembly. The pad assembly has a relatively rigid attachment plate bonded to the pad adjacent the back surface of the pad assembly and having means for securing the plate to the helmet.

A feature of the present invention is that the densified layer forms a tear-resistant cover for the front and sides of the pad assembly.

Another feature of the invention is that the integral cover provides a soft and comfortable surface for the skin of the wearer while permitting cleansing of the pad assembly.

Yet another feature of the invention is that the pad assembly maintains a shape of improved appearance while providing the desired comfort for the wearer.

A further feature of the invention is that the attachment plate may be insert molded to the pad.

Thus, another feature of the invention is that the pad assembly may be constructed in a simplified manner and at a reduced cost.

Further features will become more fully apparent in the following description of the embodiments of this invention and from the appended claims.

DESCRIPITON OF THE DRAWINGS

DESCRIPTION OF THE PREFERRED EMBODIMENTS

Figure 1:
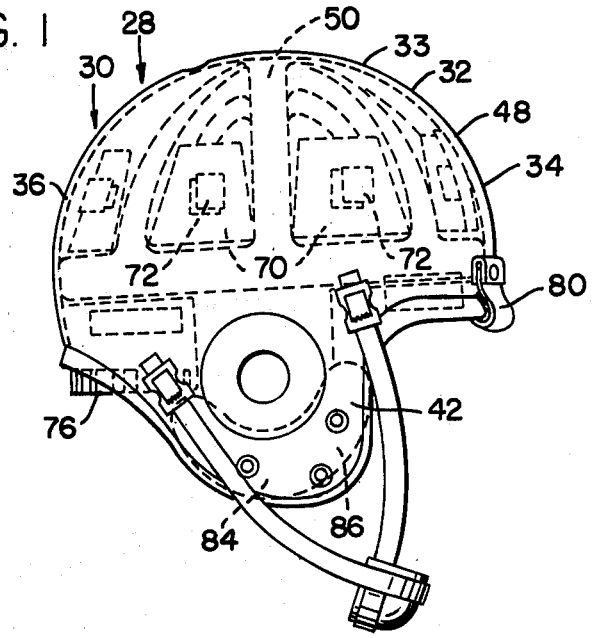
FIG. 1 is a side elevational view of a protective helmet.
Figure 5:
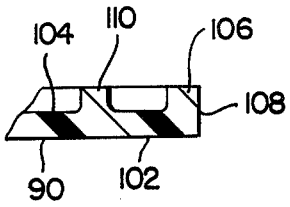
FIG. 5 is a fragmentary sectional view taken substantially as indicated along the line 5—5 of FIG. 4.
Figure 2:
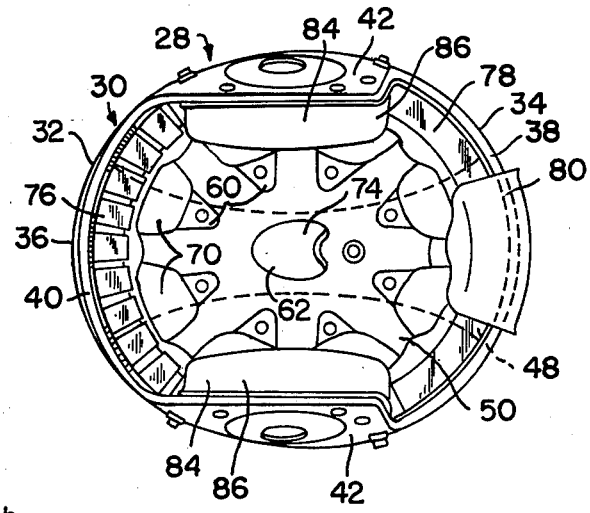
FIG. 2 is a bottom plan view of the helmet of FIG. 1.
Figure 3:
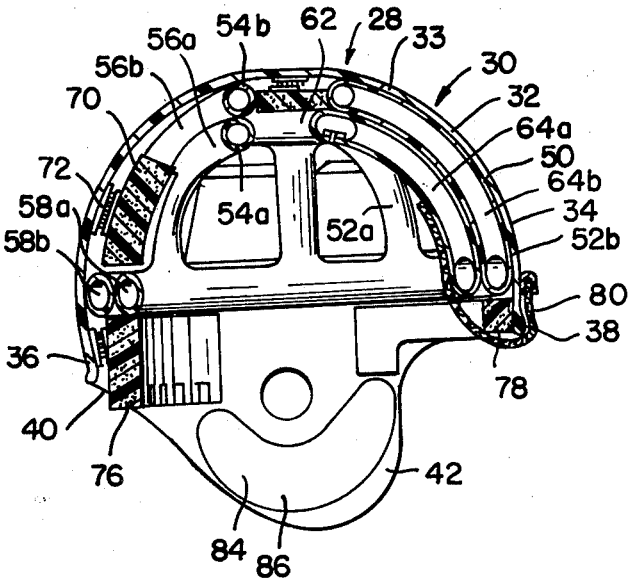
FIG. 3 is a sectional view of the helmet of FIG. 1.
Figure 4:
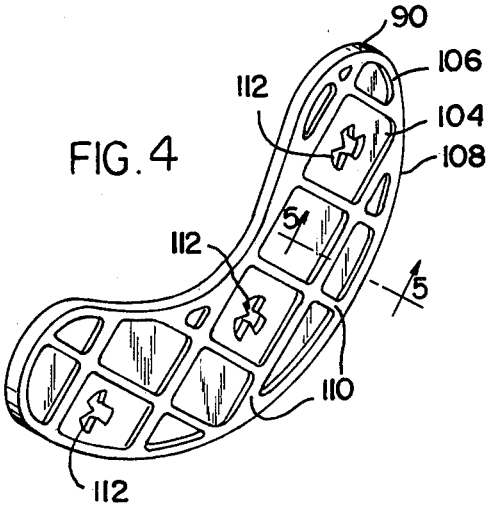
FIG. 4 is a perspective view of an attachment plate for a pad assembly of the present invention.

Referring now to FIGS. 1–3, there is shown a protective headgear 28 comprising a helmet 30. Although the headgear 28 is shown in the form of a football helmet, it will be understood that the principals of the invention may be utilized in connection with any other suitable headgear, such as hockey helmets, baseball helmets, crash helmets, or other headgear where protection of the head is desired. As shown, the helmet 30 has an outer shell 32 which is preferably made of a relatively rigid material, such as a polycarbonate alloy, a rigid thermoplastic, or a thermosetting resin. The shell 32 has an upper central portion 33, a front portion 34, a rear portion 36, a lower front edge 38, a lower rear edge 40, and a pair of ear protectors 42. The shell 32 may include a region 48 of increased thickness in the longitudinal central area of the helmet or other area of the helmet, such as in the ear protectors 42, to provide additional reinforcement to the shell where holes may be placed in the shell.

The helmet 30 also has a flexible liner means or cradle 50 positioned in the shell 32 to dissipate forces applied against the helmet. The liner means 50 has a pair of first and second nestable flexible liners or cushions **52*a* and 52*b*, respectively. The first and second liners 52*a* and *b* respectively have a hollow annular member 54*a* and 54*b* adjacent an upper central portion of the respective liner, a plurality of hollow spaced spoke members 56*a* and 56*b* extending from and communicating with the annular member 54*a* or *b* of the respective liner, and a hollow rim 58*a* and 58*b* extending peripherally around a lower end of the respective liner and communicating with the respective spoke members 56*a* or *b*. As shown, side walls of the spoke members 56*a* and *b* and rims 58*a* and *b* define a plurality of openings 60 having the general shape of isosceles triangles extending through the respective liners. Also, the annular members 54*a* and *b* define generally circular shaped openings 62 extending through the upper central portion of the respective liners with the sidewalls of the liners defining the openings 62** preventing overinflation or bulging of the upper central portions of the liners.

The hollow first liner **52*a* defines first chamber means 64*a* communicating between the annular member 54*a*, the spoke members 52*a*, and the rim 58*a*. Similarly, the second liner 52*b* defines second chamber means 64*b* communicating between the annular member 54*b*, the spoke members 56*b*, and the rim 58*b*. In a preferred form, the first and second chamber means 64***a* and *b* of the first and second liners 52*a* and *b*, respectively, are inflated with a gas, such as air, although the second chamber means 64*b* of the second liner 52*b* may be filled with a liquid to provide additional rigidity to the second liner, if desired.

The first liner 52*a* is nested within the second liner 52*b*, with the spoke members 56*a* and *b*, annular members 54*a* and *b*, and rims 58*a* and *b* of the two liners 52*a* and *b*, as well as the first and second chamber means, being generally in alignment. In this configuration, the openings 60 and 62 of the two liners are also in alignment, such that the openings extend completely through the liner means 50, and the inner liner 52*a* defines a soft conformable inner surface for contacting the wearer's head.

In a preferred form, the liners 52*a* and *b* are rotomolded, and are made from any suitable flexible or elastic material such as polyvinyl chloride plastisol, ethylene vinyl acetate, polyethylene, or liquid polyurethane. Preferably, the inner first liner 52*a* has a durometer hardness less than the durometer hardness of the second liner 52*b*, although rigidity may be added to the second liner by filling it with liquid. In a suitable structure of the liners, the inner liner 52*a* has a shore A hardness in the range of 45–55, while the shore A hardness of the second liner 52*b* may be in the range of 75–90. If both liners are inflated with a gas, the modulus of elasticity of the inner liner is preferably less than that of the outer liner, such that the inner liner provides a relatively soft conformable inner surface for contacting the wearer's head in a comfortable manner. The inner liner 52*a* readily compresses and absorbs energy in the helmet, while providing continued comfort to the wearer, resulting from impacts of relatively low force levels against the shell. The second liner 52*b* provides a more rigid structure to dissipate higher level forces applied against the shell. Thus, the liners 52*a* and *b* co-operate to absorb energy resulting from impacts against the shell of varying force levels, with the liners compressing or deforming differing amounts at the point of impact, such that the forces are dissipated in an improved manner to protect the wearer while providing continued comfort to the wearer.

The helmet has a plurality of resilient retainer pads 70 having a generally trapezoidal shape. The retainer pads 70 may be made of any suitable material such as a closed cell polyvinyl chloride foam of medium density, for example, Ensolite, a trademark of Uniroyal, or, Rubatex, a trademark of Great American Industries. The pads 70 may have their outer surfaces treated to provide washable surfaces of the pads, for example, by dipping the pads in a suitable material, such as a liquid vinyl, urethane, or latex.

A plurality of the retainer pads 70 are positioned in the aligned openings 60 of the first and second liners 52*a* and *b*, with the enlarged portion of the pads being located adjacent the bases of the triangular shaped openings 60. The pads 70 may be releasably attached to the inside of the shell 32 by suitable securing or fastening means 72 to maintain the pads 70 in place between the spoke members 56*a* and *b* of the first and second liners 52*a* and *b*. The fastening means 72 may comprise a hook and loop arrangement of known type, such as a pair of interengaging hook and loop strips, with one strip being secured to a back surface of the pads 70, and with the other strip being secured to the inner surface of the shell 32. The pads 70 may be attached in the liner openings by passing the pads through the openings and engaging the strips on the pads against the strips on the shell to interengage the strips of the fastening means 72. The pads 70 may be removed from the openings by pulling on the upper ends of the pads to release the strips on the back of the pads from the strips on the inside of the shell.

As shown in the drawings, each of the retainer pads 70 extends between adjacent spoke members 56*a* and *b* of the liner means 50, such that the inclined sides of the pads abut against side walls of the spoke members defining the openings 60 of the liner means 50. Since the retainer pads 70 are secured to the shell 32, the pads prevent rotational movement or slippage of the liners 52*a* and *b* within the shell 32. Also, the sides of the pads 70 frictionally engage the spoke members 56*a* and *b*, and the pads 70 prevent upward movement of the shell 32 relative the liner means 50. Accordingly, the liners 52*a* and *b* are held firmly in place by the pads 70 within the shell. In this regard, the pads 70 extend a sufficient distance inwardly from the shell to engage side walls of the spoke members 56*a* of the inner first liner 52*a*, although the inner surfaces of the pads 70 are spaced slightly from the inner surface of the liner means 50.

The helmet 30 also has a resilient pad 74 which is releasably positioned in the openings 62 of the liner means 50. The pad 74 may be made of any suitable material, such as the material described in connection with the retainer pads 70 above, and may have a suitable coating of washable material, as described above. The pad 74 and the shell 32 have suitable fastening means, such as the hook and loop strips discussed above, to releasably attach the pad 74 to the inside of the shell within the liner openings.

The rims 58*a* and *b* of the liner means 50 are spaced above the lower rear edge 40 of the shell 32, and an elongated rear sizer pad 76 is provided for placement in the lower rear portion of the shell. The pad 76 may be made of any suitable resilient material, such as the closed cell foam material described above in connection with the retainer pads 70, and may have a washable coating. The pad 76 preferably has a plurality of longitudinally spaced cutouts to permit bending of the pad without wrinkling when placed in the shell. The rear pad 76 is positioned below the liner means in the shell, and extends around a lower rear portion of the shell 32. The pad 76 may be releasably attached to the inner surface of the shell 32 by suitable fastening means, such as hook and loop strips, spaced longitudinally along the back surface of the pad and around the lower rear inner surface of the shell.

The rims 58*a* and *b* of the first and second liners 52*a* and *b* are also spaced above the lower front edge 38 of the shell 32, and the helmet has an elongated resilient front pad 78 to cushion the wearer's head adjacent the lower front portion of the shell. The pad 78 may be made of any suitable material, such as the closed cell foam material described above in connection with the retainer pads 70. Also, the outer surface of the front pad 78 may be coated with a washable material, as previously described. The front pad 78 is releasably attached to the lower front portion of the shell by suitable fastening means, such as hook and loop strips described above, with strips of the material being spaced longitudinally along the back surface of the pad 78 and the lower inner surface of the shell 32.

The helmet 30 has a sweat band 80 extending between the outside and the inside of the shell 32. The sweat band 80 may be made of any suitable material, such as a sheet of soft porous material which permits the transmission of water vapor through the sweat band. For example, the sweat band may be made from a poromeric polyvinyl chloride material having a reinforcement backing of woven material, such as a material sold under the trademark PORON by Rogers Corporation.

The headgear 28 also has a pair of jaw pads 84 which are releasably attached to the ear protectors 42 of the helmet 30. With reference to FIGS. 4–7, the jaw pads 84 are formed by a pad assembly 86 having a pad 88 of foam material, and a relatively rigid attachment plate 90 bonded to the pad 88. The pad assembly 86 has a back surface 92, a front surface 94, and side surfaces 96 connecting the back and front surfaces 92 and 94. The pad 88 may be made of any suitable material, such as urethane foam, and has an outer densified layer 98 defining the front surface 94 and the side surfaces 96 of the pad 88. The layer 98 is formed by suitable temperature control of the mold surface and molding time during molding of the pad 88, in addition to formulation of the foam to determine the layer thickness after the pad has been molded. The densified layer 98 forms a tear-resistant cover for the front and sides of the pad assembly 86, and permits ease of cleansing during use of the helmet. The pad 88 also has a less dense inner portion 100 which is covered by the layer 98 and which provides resiliency for the pad assembly.

The attachment plate 90 may be made of any suitable metal or plastic material, such as polyethylene, polypropylene, or acrylic copolymers. The plate 90 has a back surface 102, a front surface 104, and a rim 106 extending peripherally around the plate and defining an outer edge 108 of the plate 90. The plate 90 may have a plurality of raised members 110 extending in a web-like pattern between the outer rim 106, with both the rim 106 and the members 110 extending from the front surface 104 of the plate 90 toward the front surface 94 of the pad assembly after bonding the plate 90 to the pad 88. In addition, the plate 90 has a plurality of apertures 112 extending through the plate and located intermediate the members 110 for a purpose which will be described below.

Figure 6:
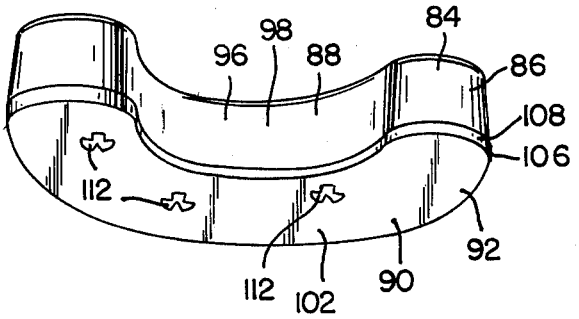
FIG. 6 is a persepective view of the pad assembly of the present invention for the protective helmet.
Figure 7:
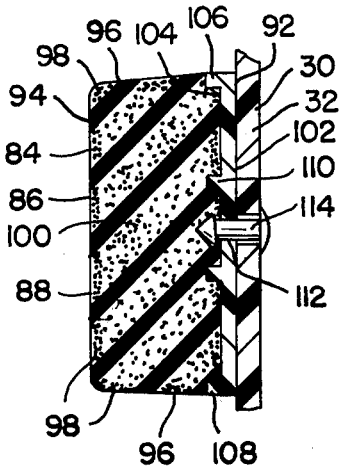
FIG. 7 is a sectional view of the pad assembly of FIG. 6 showing the pad assembly as attached to the helmet.

With reference to FIGS. 6 and 7, the plate 90 in this embodiment has outer dimensions approximately equal to the dimensions between side surfaces 96 of the pad assembly 86, such that the rim 106 is located at the side surfaces 96 of the pad assembly 86, and the plate 90 defines the entire back surface 92 of the pad assembly. The pad assembly 86 may be formed in a suitable manner, such as by insert molding the plate 90 onto the pad 88 while forming the densified layer 98 of the pad 88 during molding. Once the pad assembly is formed, the rim 106 and raised members 110 enhance the attachment strength between the plate 90 and the pad 88. Thus, the pad assembly 86 may be constructed in a simplified manner by bonding the pad 88 to the plate during insert molding and by simultaneously forming an outer densified layer or skin 98 for the pad 88. In addition, the pad assembly eliminates the necessity for separate sheets to cover a pad and separate attachment members for securing the pad assembly to the helmet. Thus, with reference to FIG. 7, inwardly extending protuberances 114 of the helmet 30 may be passed through the plate apertures 112 in order to releasably secure the pad assembly 86 to the helmet 30. Accordingly, the pad assembly of the present invention may be made in a simplified manner and at a reduced cost to minimize the cost of the pad assembly and the helmet to the consumer. It will be apparent that other pads of the headgear 28, such as the pads 70 and 74, may be constructed as described in connection with the jaw pads 84.

Figure 8:
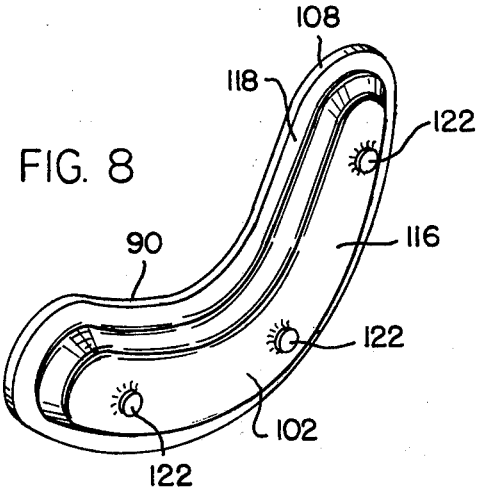
FIG. 8 is a perspective view of another emobidment of an attachment plate for the pad assembly of the present invention.
Figure 9:
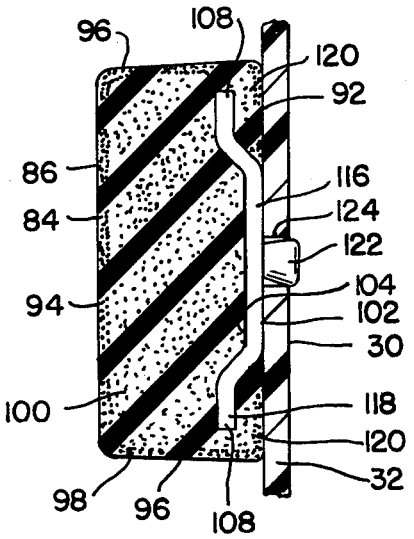
FIG. 9 is a sectional view of another embodiment of the pad assembly of the present invention as attached to the helmet.

Another embodiment of the pad assembly is illustrated in FIGS. 8 and 9, in which like reference numerals designate like parts. In this embodiment, the outer edge 108 of the plate 90 is spaced from the side surfaces 96 of the pad assembly 86. The plate has a raised back panel 116 and a recessed side portion 118 extending peripherally around the back panel 116. As shown, the back panel 116 defines a central portion of the back surface 92 of the pad assembly 86, while the plate side portion 118 is recessed from the back surface 92 of the pad assembly 86. Thus, the side portion 118 of the plate 90 is embedded in the pad 88, such that the pad 88 includes a back portion 120 located intermediate the side portion 118 of the plate 90 and the back surface 92 of the pad assembly 86. If desired, the back portion 120 of the pad may include a densified layer 98 which defines part of the back surface 92 of the pad assembly 86 intermediate the back panel 116 and the pad assembly side surfaces 96. The pad assembly 86 may be formed by insert molding the plate 90 to the pad 88, with the side portion 118 of the plate 90 being embedded in the pad 88 for improved bonding strength between the plate 90 and the pad 88. As shown, the back panel 116 of the plate 90 may have a plurality of attachment protuberances 122 extending from the back surface 102 of the plate 90. Thus, with reference to FIG. 9, the protuberances 122 of the plate 90 may be passed through suitable apertures 124 in the helmet 30 in order to releasably secure the pad assembly 86 to the helmet.

Figure 10:
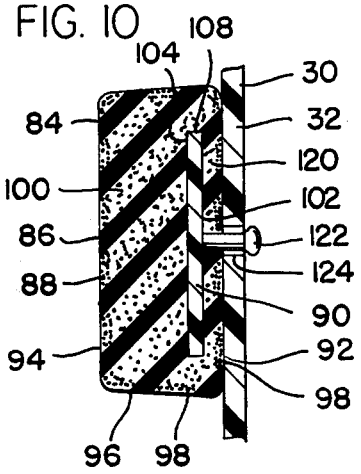
FIG. 10 is a sectional view of another embodiment of the pad assembly of the present invention as attached to the helmet.

Another embodiment of the pad assembly is illustrated in FIG. 10, in which like reference numerals designate like parts. In this embodiment, the plate 90 is spaced from the back surface 92 of the pad assembly 86, such that the plate 90 is embedded in the pad 88, and the pad 88 includes a back portion 120 located intermediate the plate 90 and the back surface 92 of the pad assembly 86. The plate 90 may have a plurality of protuberances 122 which extend through the back portion 120 of the pad 88 and past the back surface 92 of the pad assembly 86, such that outer ends of the protuberances 122 may be passed through the apertures 124 in the helmet 30 to releasably secure the pad assembly 86 to the helmet 30. The pad assembly 86 of FIG. 10 may be formed by insert molding the plate 90 in the pad 88, and may include a densified layer 98 defining the back surface 92 of the pad assembly 86.

The foregoing detailed description is given for clearness of understanding only, and no unnecessary limitations should be understood therefrom, as modifications will be obvious to those skilled in the art.

We claim:

1. A protective headgear, comprising:

a helmet; and a pad assembly having a back surface, a front surface, and side surfaces connecting said back and front surfaces, said pad assembly comprising a pad of foam material having an integral molded densified layer defining said front surface and at least a substantial part of said side surfaces, said layer being of one-piece construction with the remainder of the pad and forming a tear-resistant cover for the front and sides of said pad assembly, and a relatively rigid uniplanar attachment plate bonded by molding to said pad adjacent the back surface of the pad assembly and having means for securing the plate to the helmet, said plate being embedded in and encased by the pad, said means for securing the plate to the helmet extending through the pad, between the plate and the helmet.

2. The headgear of claim 1 wherein said layer comprises a densified outer region of foam covering a less dense inner portion of the pad.

3. The headgear of claim 1 wherein said pad assembly comprises a jaw pad for said helmet.

4. A protective headgear, comprising:

a helmet; and a pad assembly having a back surface, a front surface, and side surfaces connecting said back and front surfaces, said pad assembly comprising a pad of foam material having an integral molded densified layer defining said front surface and at least a substantial part of said side surfaces, said layer forming a tear-resistant cover for the front and sides of said pad assembly, and a relatively rigid attachment plate bonded by molding to said pad adjacent the back surface of the pad assembly and having means for securing the plate to the helmet, said plate having an outer edge spaced from the side surfaces of the pad assembly, said plate including a raised back panel in a central portion of the plate and a recessed side portion extending peripherally around the back panel, said back panel being located adjacent the back surface of the pad assembly, and said side portion being recessed from the back surface of the pad assembly and embedded in the pad with a back portion of the pad being located intermediate the side portion of the plate and the back surface of the pad assembly.

5. The headgear of claim 4 wherein said back panel defines a portion of said back surface.

6. The headgear of claim 1 or 4 wherein the securing means comprises at least one integral projection of the plate extending from the back surface of the pad assembly for placement in an aperture extending through said helmet.

7. A protective headgear, comprising:

a helmet; and a pad assembly having a back surface, a front surface, and side surfaces connecting said back and front surfaces, said pad assembly comprising a pad of foam material having an integral molded densified layer defining said front surface and at least a substantial part of said side surfaces, said layer being of one-piece construction with the remainder of the pad and forming a tear-resistant cover for the front and sides of said pad assembly, and a relatively rigid attachment plate bonded by molding to said pad adjacent the back surface of the pad assembly and having means for securing the plate to the helmet, said plate having an outer edge located coplanar with the side surfaces of the pad assembly, with said plate defining a back surface of the pad assembly, and with the plate including a rim extending peripherally around the plate at the outer edge and being directed toward the front surface of the pad assembly.

8. The headgear of claim 7 wherein said plate has a plurality of raised members directed from a front surface of the plate toward the front surface of the pad assembly to enhance the attachment strength between the plate and pad.

9. The headgear of claim 7 wherein the securing means comprises at least one aperture extending through the plate to receive an attachment member on said helmet.

* * * * *